US006126087A

United States Patent [19]

Hedger et al.

[11] Patent Number: 6,126,087

[45] Date of Patent: Oct. 3, 2000

[54] FLOWCOAT RESIN SPRAY NOZZLE AND REVERSING STRUCTURE FOR CLEANING

[75] Inventors: Thomas A. Hedger, Largo; Nicholas P. Chagaris, Tarpon Springs, both of Fla.

[73] Assignee: Graves Spray Supply, Inc., Clearwater, Fla.

[21] Appl. No.: 09/243,152

[22] Filed: Feb. 2, 1999

[51] Int. Cl.[7] ..... B05B 15/02

[52] U.S. Cl. ..... 239/119; 239/600

[58] Field of Search ..... 239/119, 600

[56] References Cited

U.S. PATENT DOCUMENTS

| | | | |
|---|---|---|---|
| 700,009 | 5/1902 | Bean | 239/119 X |
| 949,489 | 2/1910 | Mastin | 239/119 |
| 3,035,775 | 5/1962 | Klemp . | |
| 3,647,138 | 3/1972 | Houser . | |
| 3,955,763 | 5/1976 | Pyle et al. | 239/119 |
| 4,157,163 | 6/1979 | Pinto et al. | 239/119 |
| 4,516,724 | 5/1985 | Hellman | 239/119 |
| 4,629,121 | 12/1986 | Hengesbach | 239/119 |
| 4,830,281 | 5/1989 | Calder | 239/119 |
| 5,255,848 | 10/1993 | Rhodehouse | 239/119 |
| 5,454,515 | 10/1995 | Perret | 239/119 |
| 5,704,548 | 1/1998 | Hedger et al. . | |
| 5,749,528 | 5/1998 | Carey et al. | 239/119 |

FOREIGN PATENT DOCUMENTS

| | | | |
|---|---|---|---|
| 1479122 | 5/1989 | U.S.S.R. | 239/119 |

*Primary Examiner*—Andres Kashnikow
*Assistant Examiner*—Robin O. Evans
*Attorney, Agent, or Firm*—Larson & Larson, P.A.; James E. Larson

[57] ABSTRACT

A row of openings on the same axis are located on a rotary fitting mounted on a front face of a cylindrical nozzle body having a longitudinal bore. A nozzle retainer is mounted within the longitudinal bore and has a tapered seal within an inner channel. A passageway within the tapered seal aligns with a channel in the rotary fitting leading to the row of openings. A filled resin is pumped through the nozzle openings via a standard resin gun. When the nozzle openings plug with resin, the rotary fitting is turned 180 degrees and the plug material is evacuated by a pressurized fluid.

14 Claims, 3 Drawing Sheets

FLOWCOAT RESIN SPRAY NOZZLE AND REVERSING STRUCTURE FOR CLEANING

BACKGROUND OF THE INVENTION

This invention relates to a resin spray nozzle and a reversing structure for cleaning. More particularly, the invention refers to a spray nozzle apparatus having a nozzle body accepting a rotary fitting containing a row of orifices on a common axis receiving a resin stream through a passageway within a nozzle component. The invention comprises a further improvement over the invention disclosed in U.S. Pat. Nos. 4,854,504 and 5,704,548. In the interest of reducing the release of volatile organic vapors from resin sprays used in the fiberglass reinforced plastic industry, nozzles called a flowcoat have been created to form a spray pattern that decreases the amount of volatile organic vapors released from the spray pattern. The resins' stream also contains up to 62% of a filler that can have a diameter of 20 to 35 microns. Unfortunately, the present use of a filler, required in most resin coatings, causes the multiple orifices in the flowcoat nozzle to frequently clog. There is a need for a reversing mechanism that will ameliorate this clogging problem.

SUMMARY OF THE INVENTION

The present invention creates a spray nozzle having a row of openings on the same axis located on a rotary fitting mounted on a nozzle body housing face. The spray nozzle is mounted on the front end of a resin spray gun. A nozzle retainer is mounted within the nozzle body and is held in place by a tapered seal within a channel in the retainer. A passageway running through the seal is aligned with the nozzle openings in the rotary fitting. The nozzle openings are mounted in a forwardly directing manner when resin is sprayed and are reversed 180 degrees in a backward facing configuration with respect to the passageway when a fluid under pressure is sprayed through the passageway to clear out any clogging in the nozzle orifices.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
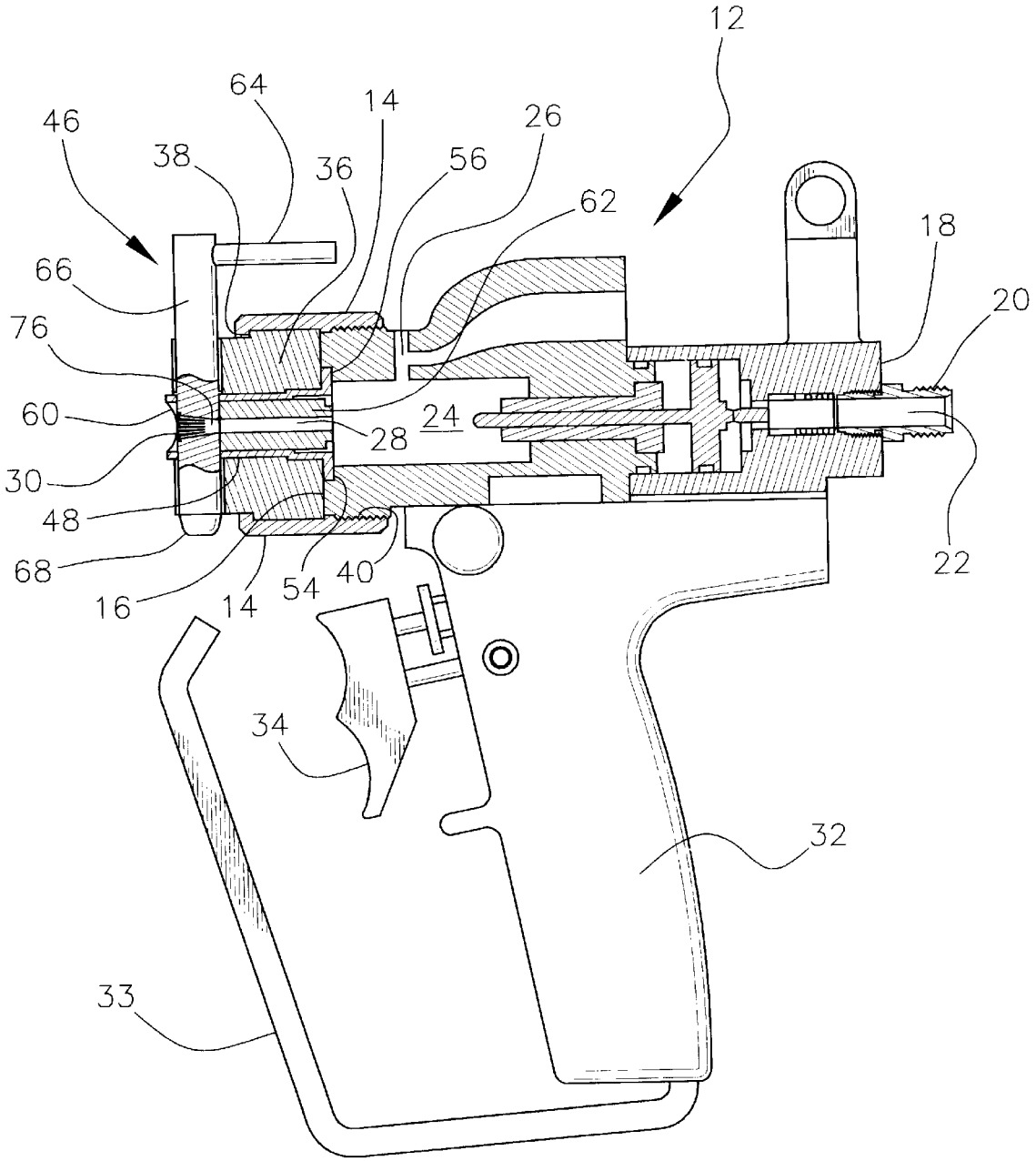
FIG. 1 is a sectional view in elevation of a resin spray gun adapted to receive the nozzle of this invention.

Throughout the following detailed description, the same reference numerals refer to the same elements in all FIGS. Referring to FIG. 1, the nozzle 10 is mounted on a resin spray gun 12 with a locking ring 14 holding the nozzle 10 in position the front portion 16 of the spray gun 12. A rear portion 18 of the resin gun 12 has threads 20 for engagement with a fitting to receive a conduit transporting either a resin or pressurized air. A passageway 22 directs the resin to a chamber 24 where the resin is mixed with a filler from passageway 26. Thereafter, the filled resin passes through channel 28 within a tapered seal 62 mounted within a nozzle retainer 48 in the nozzle 10 and exits through openings 30 which are a row of elliptical or round openings in the same axis. The spray gun has a handle 32 and an actuator 34 that causes the spray gun to pass resin or a pressurized fluid to orifices 30.

Figure 2:
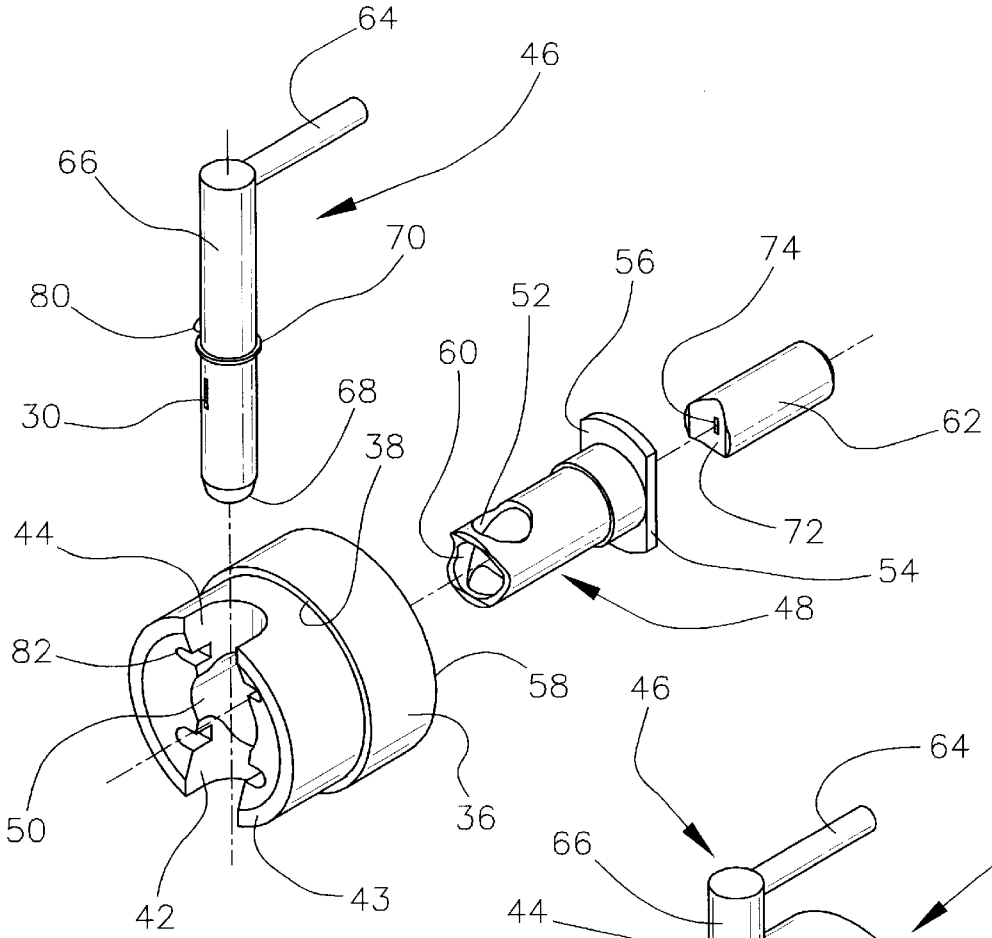
FIG. 2 is an exploded view of the nozzle of this invention.
Figure 3:
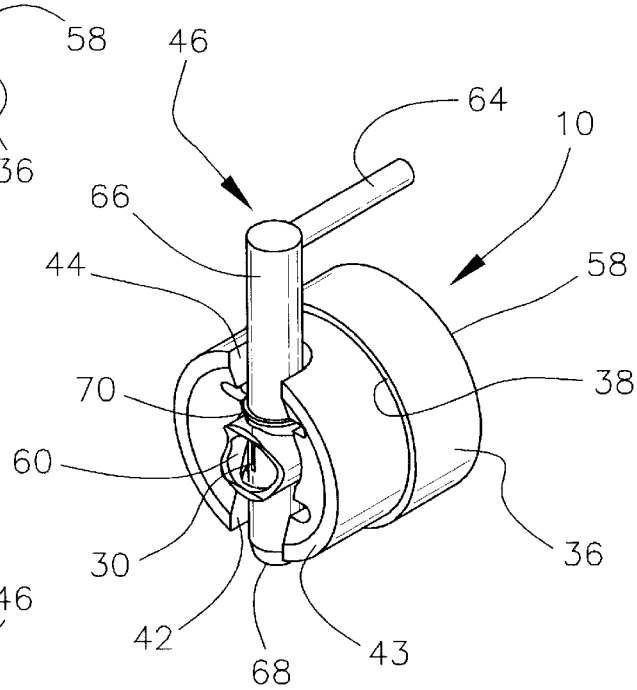
FIG. 3 is a perspective view of the nozzle of this invention.
Figure 4:
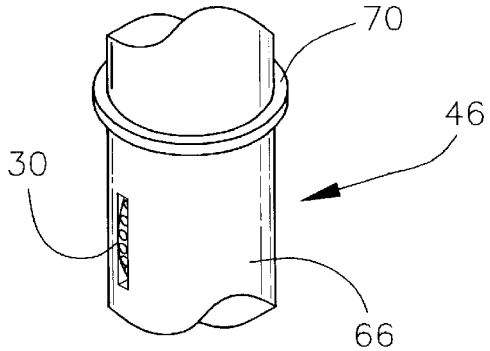
FIG. 4 is a partial view of the rotary fitting portion of the invention showing the multiple orifices on the same axis.

Referring to FIGS. 2–4, a nozzle 10 has a body housing 36 that is cylindrical in exterior shape with a shoulder 38 on an exterior portion for use in engaging the locking ring 14 on the resin spray gun 12. Threads 40 on the locking ring 14 engage complimentary threads on an interior portion of the spray gun 12 in order to screw the locking ring into place and hold the nozzle 10 in position at the front end 16 of the spray gun.

Figure 6:
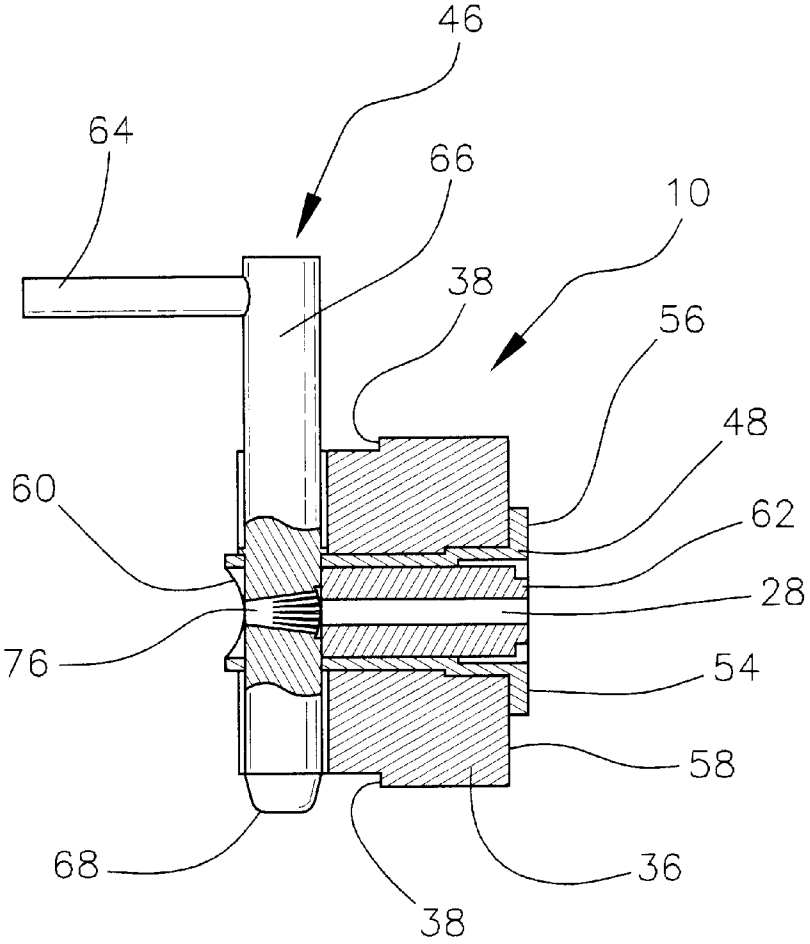
FIG. 6 is a sectional view showing the multiple orifices facing the reverse direction from that shown in FIG. 5 for cleaning such orifices.
Figure 5:
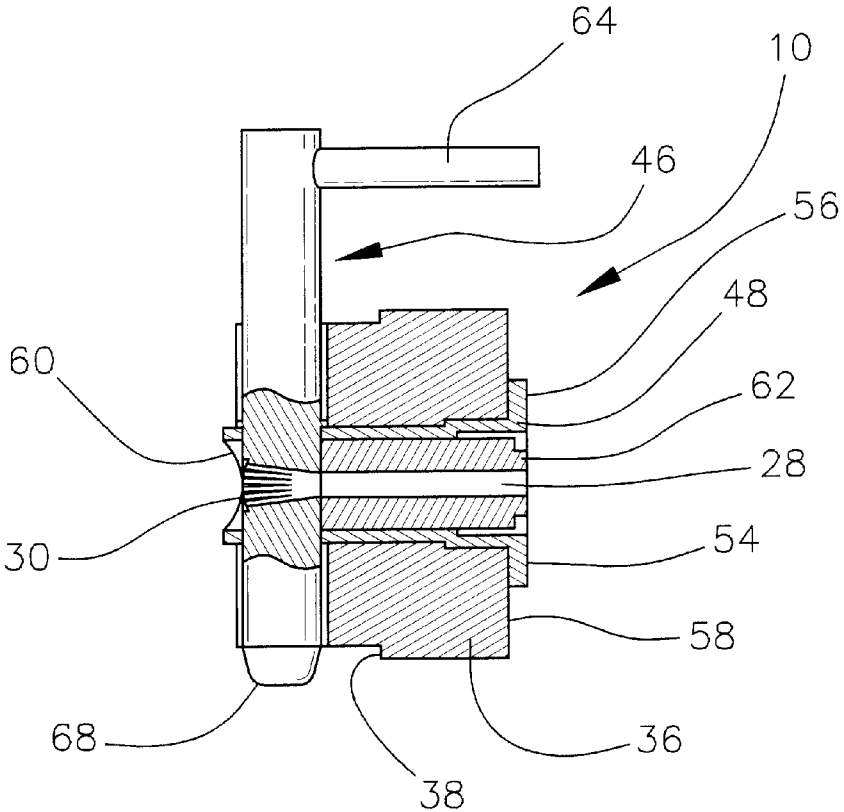
FIG. 5 is a sectional view showing the multiple orifices aligned with the passageway for spraying resin.

At a front end 43 of the nozzle body 36 there are two oppositely positioned U-shaped slots 42 and 44 for receiving a cylindrical rotary fitting 46. A nozzle retainer 48 is inserted into a passageway 50 within the nozzle body housing 36. The nozzle retainer 48 has an opening 52 which aligns with the slots 42 and 44 of the nozzle body 36 when the nozzle retainer 48 is inserted within the passageway 50. As seen in FIGS. 5–6 the side walls 54 and 56 of the nozzle retainer 48 abut against a back wall 58 of the nozzle body. The rotary fitting 46 is inserted through opening 44, through opening 52 and then through opening 42 in order to align the nozzle openings 30 with the nozzle retainer 48. An annular flange acting as a stop 70 on the rotary fitting 46 prevents the rotary fitting 46 from falling entirely through the opening 52.

A tapered seal 62 is inserted into the passageway 60 of nozzle retainer 48 at a back end in order to retain the components in position. An opening 74 to passageway 28 in the tapered seal ultimately is aligned with nozzle openings 30 and channel 76 in the rotary fitting 46.

The orifices 30 are designed to flare outwardly to form a compact spray pattern when resin and filler are being sprayed. If the nozzle openings 30 become clogged then actuating handle 64 is turned 180 degrees so that the flared ends of the nozzle openings face inwardly towards channel 76 and orifice 74 in the tapered seal. The rotary fitting has a circular cylindrical body 66 and a pointed rounded end 68 which facilitates turning within openings 52, 42 and 44. An annular flange or shoulder 70 on the rotary fitting 46 rests on top of opening 52 in the nozzle retainer so that it cannot be pushed through its entire length through opening 52. A locking tip 80 engages to groove 82 in nozzle body housing 36 to lock the rotating fitting 46 in position.

A concave forward surface 72 of the tapered seal 62 conforms to a portion of the opening 52 in the nozzle retainer. Air is pumped through passageway 28 in the tapered seal out through orifice 74 and through channel 76 to the multiple orifices 30 in order to clean out resin and filler clogging such orifices.

The nozzle and its components are made of stainless steel or other high quality metal. The tapered seal is preferably made of a high molecular weight polyethylene or like polymer.

As such an invention has been disclosed in terms of a preferred embodiment thereof which fulfills each and every aspect of the invention and provides a new and useful spray nozzle having air-shaping nozzles and reversing structure cleaning.

Of course, various changes, modifications and alterations of the teaching of the present invention may be contemplated by those skilled in the art without departing from the intended sphere and scope thereof.

As such it is intended that the present invention only be limited by the terms of the following claims.

What is claimed is:

1. A resin spray flowcoat nozzle comprising:

a) a cylindrical body housing having a central longitudinal bore and a pair of U-shaped openings in a front face;

b) a rotary fitting rotatably received in the U-shaped openings in the body housing, the rotary fitting carrying a row of at least three orifices along a common axis;

c) a central passageway for receipt of a resin or pressurized air within a tapered seal inserted into a nozzle retainer mounted within the central longitudinal bore of the cylindrical body housing; and d) the rotary fitting being rotatable between first and second orientations, whereby in the first orientation the rotary fitting row of at least three orifices are flared outwardly and aligned with the central passageway in a forwardly facing direction and in the second orientation the rotary fitting row of at least three orifices are flared outwardly and aligned with the central passageway in a rearwardly facing direction to facilitate back-flushing of the nozzle with a pressurized fluid.

2. The resin spray nozzle according to claim 1 wherein the nozzle retainer has an opening in a top surface aligned with the U-shaped openings in the front face of the cylindrical body housing.

3. The resin spray nozzle according to claim 2 wherein the nozzle retainer has a pair of side walls in a rear end, the side walls abutting a rear end of the cylindrical body housing.

4. The resin spray nozzle according to claim 1 wherein the tapered seal has a concave front end.

5. The resin spray nozzle according to claim 1 wherein the rotary fitting has an annular flange on an exterior cylindrical surface to engage a top surface of the nozzle retainer.

6. The resin spray nozzle according to claim 5, wherein the rotary fitting has a locking tip on the exterior cylindrical surface above the annular flange for engagement with a groove on the front face of the cylindrical body housing.

7. A resin spray gun having a resin spray flowcoat nozzle at a front exit portal and a source of resin at a rear entrance portal, the spray gun nozzle comprising:

a) a cylindrical housing having a central longitudinal bore and a pair of U-shaped openings in a front face;

b) a rotary fitting rotatably received within the U-shaped openings in the housing face, the rotary fitting having a row of three or more closely spaced apart openings flared outwardly along a common longitudinal axis;

c) a central passageway within a tapered seal for receipt of a resin or pressurized air, the tapered seal inserted within a nozzle retainer mounted within the central longitudinal bore;

d) the rotary fitting being rotatable between first and second orientations, whereby in the first orientation, the row of closely spaced apart openings flared outwardly on the rotary fitting are aligned with the central passageway in a forwardly facing direction and in the second orientation in a rearwardly facing direction to facilitate back-flushing of the nozzle with a pressurized fluid.

8. The resin spray nozzle mounted on the resin spray gun of claim 7 wherein the nozzle retainer has an opening in a top surface aligned with the U-shaped openings in the front face of the cylindrical body housing.

9. The resin spray nozzle mounted on the resin spray gun of claim 8 wherein the nozzle retainer has a pair of side walls in a rear end, the side walls abutting a rear end of the cylindrical body housing.

10. The resin spray nozzle mounted on the resin spray gun of claim 7 wherein the openings in the rotary fitting are circular.

11. The resin spray nozzle mounted on the resin spray gun of claim 7 wherein the tapered seal has a concave front end containing an opening from the central passageway.

12. The resin spray nozzle mounted on the resin spray gun of claim 7 wherein the rotary fitting has an annular flange on an exterior cylindrical surface to engage a top surface of the nozzle retainer and a locking tip mounted above the flange to engage a groove on the front face of the cylindrical body housing.

13. The resin spray nozzle mounted on the resin spray gun of claim 7 wherein the rotary fitting has an attached handle for turning the rotary fitting 180 degrees from the first orientation to the second orientation.

14. A resin spray flowcoat nozzle mounted on a front portion of a resin spray gun which mixes filler with resin, the nozzle comprising:

a) a cylindrical body housing having a central longitudinal bore, a first and second U-shaped opening in a front face separated by an opening to the central longitudinal bore b) a rotary fitting rotatably received in the U-shaped openings perpendicular to the front face on the body housing, the rotary fitting having a row of three or more spaced apart circular orifices flared outwardly along a longitudinal axis and an annular flange on an exterior surface;

c) a nozzle retainer mounted within the central longitudinal bore, the nozzle retainer having an opening in a top surface of a front portion for receipt of the rotary fitting and having a longitudinal opening in a back portion for receipt of a tapered seal;

d) the tapered seal having a concave front portion with an opening from a central longitudinal passageway for receipt of a resin or pressurized air;

e) the rotary fitting being rotatable between first and second orientations, whereby in the first orientation the row of three or more spaced apart circular orifices flared outwardly are aligned with the tapered seal central passageway in a forwardly facing direction for spraying resin and in the second orientation in a rearwardly facing direction to facilitate back-flushing of the orifices with pressurized fluid.

* * * * *